US007715748B2

(12) United States Patent
Shin et al.

(10) Patent No.: US 7,715,748 B2
(45) Date of Patent: May 11, 2010

(54) ELECTROPHOTOGRAPHIC IMAGE FORMING APPARATUS AND DEVELOPING METHOD THEREOF

(75) Inventors: Kyu-cheol Shin, Seoul (KR); Masahiko Itaya, Suwon-si (KR); Tsutomu Sasaki, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 872 days.

(21) Appl. No.: 11/541,639

(22) Filed: Oct. 3, 2006

(65) Prior Publication Data

US 2007/0092288 A1 Apr. 26, 2007

(30) Foreign Application Priority Data

Oct. 25, 2005 (KR) ..... 10-2005-0100912

(51) Int. Cl.
*G03G 21/00* (2006.01)

(52) U.S. Cl. ..... 399/99

(58) Field of Classification Search ..... 399/103, 399/99, 284, 274

See application file for complete search history.

(56) References Cited

U.S. PATENT DOCUMENTS 4,387,982 A 6/1983 Stanley
6,041,204 A * 3/2000 Haneda et al.
6,256,466 B1 * 7/2001 Ota et al. ..... 399/103
6,829,452 B2 * 12/2004 Tanimoto et al. ..... 399/103
2007/0071506 A1 * 3/2007 Uetake et al.

FOREIGN PATENT DOCUMENTS

| | | |
|---|---|---|
| CN | 1062606 A | 7/1992 |
| JP | 55-041449 | 3/1980 |
| JP | 60-3680 | 1/1985 |
| JP | 62-269180 | 11/1987 |
| JP | 06-051649 | 2/1994 |
| JP | 2004-219711 | 8/2004 |
| KR | P1990-19115 | 11/1990 |
| KR | P1993-5339 | 3/1993 |
| KR | 10-2003-0043139 | 6/2003 |

* cited by examiner

*Primary Examiner*—Susan S Lee
(74) *Attorney, Agent, or Firm*—Roylance, Abrams, Berdo & Goodman, L.L.P.

(57) ABSTRACT

An electrophotographic image forming apparatus and a developing method thereof are provided. The electrophotographic image forming apparatus includes an image carrier body on which an electrostatic latent image is formed, a developing roller which faces the image carrier body and supplies toner to the electrostatic latent image formed on the image carrier body, and an anti-toner-dispersion element which faces an outer circumferential surface of the image carrier body between an exposing section where the electrostatic latent image is formed and a developing section where the electrostatic latent image is developed by the developing roller. A collection bias is applied to the anti-toner-dispersion element to collect dispersed toner from the developing roller.

19 Claims, 2 Drawing Sheets

ELECTROPHOTOGRAPHIC IMAGE FORMING APPARATUS AND DEVELOPING METHOD THEREOF

CROSS-REFERENCE TO RELATED PATENT APPLICATION

This application claims the benefit under 35 U.S.C. §119 (a) of Korean Patent Application No. 10-2005-0100912, filed on Oct. 25, 2005, in the Korean Intellectual Property Office, the entire disclosure of which is hereby incorporated by reference.

BACKGROUND OF THE INVENTION

1. Field of the Invention

The present invention relates to an electrophotographic image forming apparatus and a developing method thereof. More particularly, the present invention relates to an electrophotographic image forming apparatus that can minimize or prevent toner dispersion by employing an anti-toner-dispersion element that collects the toner dispersed during a developing process, and a developing method thereof.

2. Description of the Related Art

Electrophotographic image forming apparatuses such as copy machines, printers, facsimiles, and multi-function printers develop a toner image by supplying toner to an electrostatic latent image on an image carrier body which is formed from a digital image signal.

FIG. 1 shows a conventional electrophotographic image forming apparatus, which includes an image carrier body 1, a developing roller 2, a charging unit 5, and an exposing unit 7.

The charging unit 5 contacts one side of the image carrier body 1, and the developing roller 2 faces another side of the image carrier body 1. Light is exposed onto the outer circumferential surface of the image carrier body 1 between the developing roller 2 and the charging unit 5 using a laser beam irradiated by the exposing unit 7.

The outer circumferential surface of the image carrier body 1 is charged to a uniform electric potential by the charging unit 5, and is then exposed to the laser beam irradiated by the exposing unit 7 in response to a digital image signal to form an electrostatic latent image. As the image carrier body 1 rotates, the electrostatic latent image formed on the image carrier body 1 moves towards the developing roller 2. As the electrostatic latent image moves to the closest position between the image carrier body 1 and the developing roller 2, some toner of a toner layer formed on the developing roller 2 moves onto the electrostatic latent image by an electrostatic force so that the electrostatic latent image is developed as a toner image. The developed toner image is transferred and printed onto a recording medium, while the image carrier body 1 rotates.

As the printing speed becomes higher, the developing roller 2 rotates faster. This may disperse toner during a developing process by centrifugal force due to the rotation of the developing roller 2 or by an air current generated by the rotation of the image carrier body 1 or the developing roller 2. The dispersed toner may contaminate the inside of a developing unit containing the developing roller 2 and the image forming apparatus, or may contaminate a non-image portion of the image carrier body 1 if the toner is dispersed between an exposing section and a developing section of the image carrier body 1. In particular, since the toner may not be sufficiently charged due to high speed printing, more reverse polarity toner is present in the toner layer formed on the developing roller 2, and the reverse polarity toner is attached to the non-image portion of the image carrier body 1. As a result, the reverse polarity toner contaminates the non-image portion and remains intact during the developing process, which leads to image contamination.

Accordingly, there is a need for an improved electrophotographic image forming apparatus which minimizes toner dispersion.

SUMMARY OF THE INVENTION

An aspect of the present invention is to address at least the above problems and/or disadvantages and to provide at least the advantages described below. Accordingly, an aspect of the present invention is to provide an electrophotographic image forming apparatus that can minimize or effectively prevent toner dispersion and thus reduce contamination by dispersed toner by recycling the dispersed toner, thereby preventing image quality deterioration, and a developing method thereof.

According to an aspect of the present invention, an electrophotographic image forming apparatus comprises an image carrier body on which an electrostatic latent image is formed, a developing roller which faces the image carrier body and supplies toner to the electrostatic latent image formed on the image carrier body, and an anti-toner-dispersion element which faces an outer circumferential surface of the image carrier body between an exposing section where the electrostatic latent image is formed and a developing section where the electrostatic latent image is developed by the developing roller. A collection bias is applied to the anti-toner-dispersion element to collect dispersed toner from the developing roller.

According to another aspect of the present invention, a method for developing an electrostatic latent image comprises the steps of exposing an image carrier body in an exposing section to form an electrostatic latent image on the image carrier body, and supplying toner from a developing roller having a toner layer onto the image carrier body on which the electrostatic latent image is formed in a developing section. Straight polarity toner dispersed between the exposing section and the developing section is attached to the image carrier body, and reverse polarity toner dispersed to the developing roller is attached to the electrode by applying a bias to an electrode which faces the outer circumferential surface of the image carrier body between the exposing section and the developing section. The straight polarity toner attached to a non-image portion of the image carrier body is collected onto the developing roller in a developing section using a developing bias applied to the developing roller.

According to yet another aspect of the present invention, an electrophotographic image forming apparatus comprises an image carrier body, an exposing unit for irradiating light onto the image carrier body to form an electrostatic latent image of the image carrier body, the exposing unit being located in an exposing section, a developing roller for supplying toner to the electrostatic latent image formed on the image carrier body to develop the electrostatic latent image, the developing roller being located in a developing section, and means for minimizing toner dispersion disposed between the exposing section and the developing section.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention and are merely exemplary. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Exemplary embodiments of an electrophotographic image forming apparatus and a developing method thereof of the present invention will now be described in detail with reference to the accompanying drawings.

Figure 1:
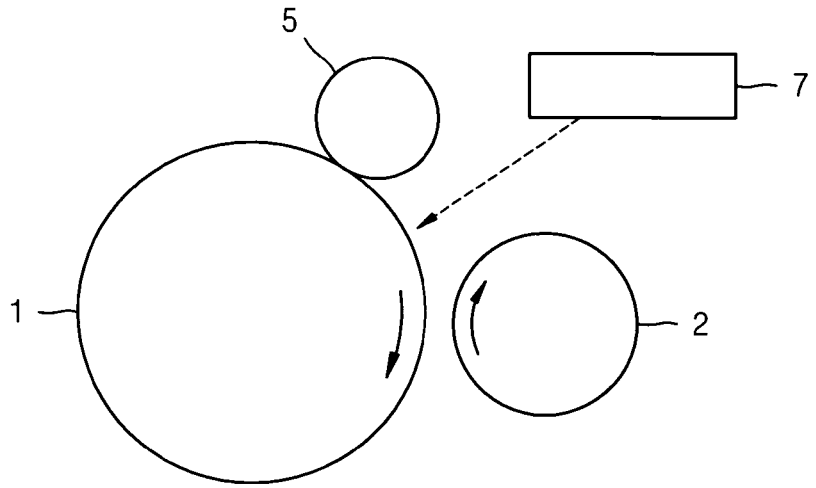
FIG. 1 (PRIOR ART)
FIG. 1 is a schematic view of a conventional electrophotographic image forming apparatus.
Figure 2:
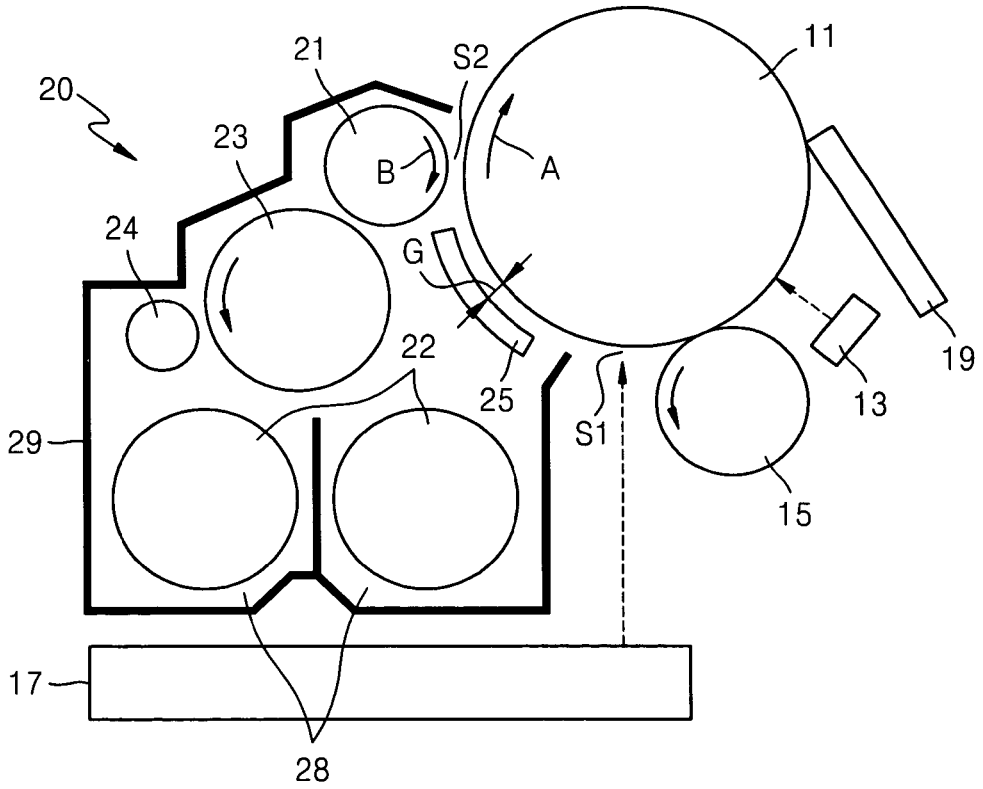
FIG. 2 is a schematic view of an electrophotographic image forming apparatus according to an exemplary embodiment of the present invention.

FIG. 2 is a schematic view of an electrophotographic image forming apparatus according to an exemplary embodiment of the present invention. The electrophotographic image forming apparatus includes an image carrier body 11 and a developing unit 20 having an anti-toner-dispersion element 25.

The image carrier body 11 is an organic photoconductive drum in the present exemplary embodiment. However, the image carrier body 11 may be another type of photoconductor, such as an amorphous silicon photoconductor. A charging unit 15 and an exposing unit 17 are provided to form an electrostatic latent image on the image carrier body 11. The charging unit 15 may be a corona discharger. The charging unit 15 contacts and charges the image carrier body 11. The exposing unit 17 may be a laser scanning unit (LSU) irradiating a laser beam. The image carrier body 11 may be an electrostatic drum (not shown). In this case, to form an electrostatic latent image, an electrostatic recording head (not shown) is used instead of the exposing unit 17.

The developing unit 20 includes a developing roller 21, the anti-toner-dispersion element 25, a stirrer 22 for supplying charged toner to the developing roller 21, a magnetic roller 23, a trimmer 24, and a frame 29 of the developing unit 20 which contains the stirrer 22, the magnetic roller 23, and the trimmer 24.

The developing roller 21 is located between the image carrier body 11 and the magnetic roller 23. The developing roller 21 and the image carrier body 11 are separated from each other by a gap. The gap between the image carrier body 11 and the developing roller 21 is typically at least 100~400 μm, and is preferably 150~300 μm. The developing roller 21 is an aluminum or stainless steel sleeve which is coated with an oxide layer having a volume resistivity of less than $10^{12}$ Ω·cm, or covered with a conductive resin having the same volume resistivity on the outer circumferential surface thereof.

The anti-toner-dispersion element 25 faces the outer circumferential surface of the image carrier body 11 between an exposing section S1 for forming the electrostatic latent image and a developing section S2 for developing the electrostatic latent image by the developing roller 21 without contact. A collection bias is applied to the anti-toner-dispersion element 25 to collect dispersed toner from the developing roller 21.

If the anti-toner-dispersion element 25 is too close to the image carrier body 11, the collection bias applied to the anti-toner-dispersion element 25 may affect the electrostatic latent image formed on the image carrier body 11. If the anti-toner-dispersion element 25 is not close enough to the image carrier body 11, an electric field in a collection section S3 between the image carrier body 11 and the anti-toner-dispersion element 25 may decrease to weaken the electrostatic force which allows the toner to be collected. For example, if the toner is charged to 10~40 μC/g, the electric field in the collection section S3 may be more than 100 V/mm. If the electric potential difference between the image carrier body 11 and the anti-toner-dispersion element 25 is 500 V, the distance G between the image carrier body 11 and the anti-toner-dispersion element 25 may be less than 5 mm.

The anti-toner-dispersion element 25 is separated from the outer circumferential surface of the image carrier body 11 by the uniform distance G, so that a uniform electric field can be formed between the image carrier body 11 and the anti-toner-dispersion element 25.

The anti-toner-dispersion element 25 is a conductive electrode that allows a current to flow, such as a metal plate, a plurality of wires, or a metal mesh.

The operation of the image forming apparatus will now be described.

The image carrier body 11 rotates in the direction of the arrow A shown in FIG. 2.

Figure 4:
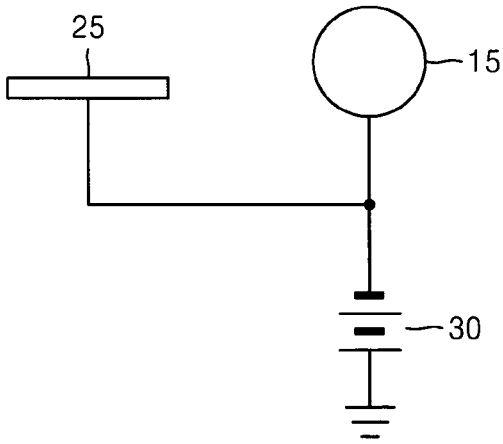
FIG. 4 shows the structure of a power source for supplying a collection bias to an anti-toner-dispersion element.

A charging bias is applied to the charging unit 15 by a power source 30 (see FIG. 4). The charging unit 15 uniformly charges the outer circumferential surface of the image carrier body 11 by contacting the photoconductive image carrier body 11.

While rotating at a constant speed under the control of a control unit (not shown), an exposing process by the exposing unit 17 is performed on the image carrier body 11 charged to a uniform electric potential by the charging unit 15. In the exposing process, image data is converted into a laser beam by the exposing unit 17 so as to be irradiated onto the outer circumferential surface of the image carrier body 11. At this time, the outer circumferential surface of the image carrier body 11 is exposed to the laser beam to form the electrostatic latent image thereon. The electrostatic latent image formed on the image carrier body 11 reaches the developing section S2 by the rotation of the image carrier body 11.

The developing unit 20 stores non-magnetic toner and magnetic carriers. The carriers may be any suitable magnetic carrier. The stirrer 22 stirs the carriers and toner to charge the toner due to friction. The toner may be negatively or positively charged. Toner which is charged with a polarity suitable for use in the developing process is referred to as straight polarity toner, while toner charged to have an opposite polarity is referred to as reverse polarity toner. Most toner has a straight polarity in the charging process, but some toner may have a reverse polarity.

The carriers are attached to the outer circumferential surface of the magnetic roller 23 by a magnetic force of the magnetic roller 23, and the toner is attached to the carriers by electrostatic force, thereby forming a magnetic brush having the carriers and the toner on the outer circumferential surface of the magnetic roller 23. The trimmer 24 controls the magnetic brush to a uniform thickness.

Supply and developing biases are applied to the magnetic roller 23 and the developing roller 21. The supply bias supplies an electric field between the magnetic roller 23 and the developing roller 21, which moves the toner from the magnetic roller 23 to the developing roller 21. The supply bias may have both direct current and alternating current components. A toner layer is formed on the outer circumferential surface of the developing roller 21 by the supply bias.

The developing roller 21 rotates in the direction indicated by the arrow B, which is the same as the rotation direction A of the image carrier body 11, so that the portions of the developing roller 21 and the image carrier body 11 which face each other travel in opposite directions. For example, referring to the drawing, when the image carrier body 11 rotates clockwise, the developing roller 21 also rotates clockwise. The present invention is not limited to these directions, however.

When a developing bias is applied to the developing roller 21, an electrostatic force is generated by an electric potential difference between the image carrier body 11 and the developing roller 21. When the toner attached on the developing roller 21 approaches the image carrier body 11 due to the rotation of the developing roller 21, the toner is separated from the toner layer on the developing roller 21 by the electrostatic force and attached to an image portion on the image carrier body 11 to form the electrostatic latent image. To develop the electrostatic latent image into a toner image, a direct current and an alternating current may be combined in the developing bias. Here, the image portion denotes a portion of the outer circumferential surface of the image carrier body 11 on which the laser beam is exposed during the exposing process to generate an electric potential difference with respect to the electric potential of the charging bias and thus hold the toner to form the electrostatic latent image. The area of the outer circumferential surface of the image carrier body 11 to which no toner is attached is referred to as a non-image portion. The non-image portion is not exposed to the laser beam during the exposing process, so that the electric potential by the charging bias remains intact.

Next, the toner image is transferred onto a recording medium. The toner image is fixed onto the recording medium by heat and pressure. A cleaning blade 19 and a charge removing unit 13 remove toner and any remaining electric charge after the transferring process is performed.

During the developing process, the toner is separated from the developing roller 21 and moved towards the image carrier body 11. At this time, some toner is dispersed by centrifugal force due to the rapid rotation of the developing roller 21 or by an air current generated due to a rotation of the image carrier body 11 or the developing roller 21.

In a developing method of the present invention, when toner is dispersed during the developing process, the toner dispersed onto the exposing section S1 and the developing section S2 of the image carrier body 11 is collected. To this end, as shown in FIG. 2, the image forming apparatus of the present invention includes the anti-toner-dispersion element 25 which is located between the exposing section S1 and the developing section S2 of the image carrier body 11 on the downstream side with respect to the rotation direction (direction B) of the developing roller 21. The anti-toner-dispersion element 25 may be used even when the developing roller 21 rotates in the opposite direction with respect to the image carrier body 11 (that is, the when the developing roller rotates counter-clockwise), since some toner dispersed from the developing roller 21 may move between the exposing section S1 and the developing section S2 of the image carrier body 11.

Figure 3:
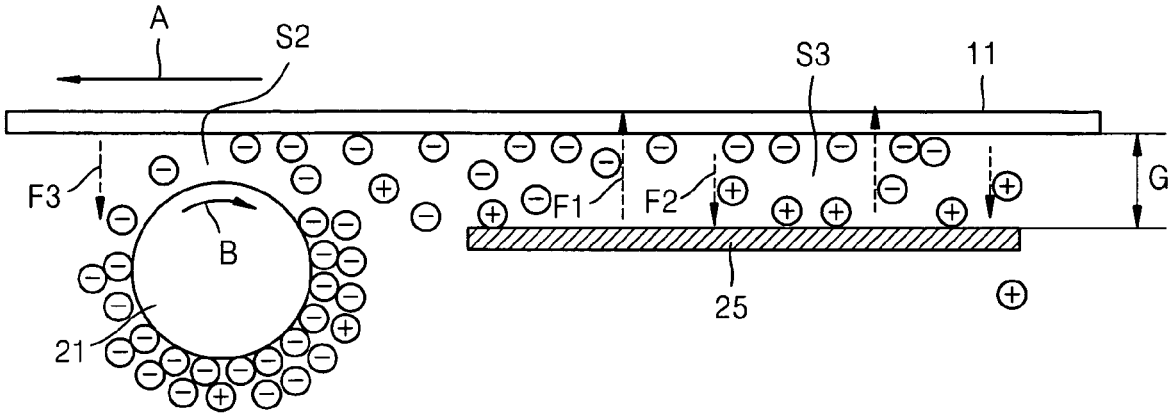
FIG. 3 illustrates how toner can be prevented from being dispersed in an electrophotographic image forming apparatus of the present invention.

FIG. 3 shows how toner dispersed from the developing roller 21 is collected by the anti-toner-dispersion element 25.

The collection bias is applied to the anti-toner-dispersion element 25. Dispersed straight polarity toner is influenced by an electrostatic force F1 towards the image carrier body 11, and dispersed reverse polarity toner is influenced by an electrostatic force F2 towards the anti-toner-dispersion element 25. As a result, in the toner which is dispersed from the developing roller 21 and which moves to the collection section S3 between the image carrier body 11 and the anti-toner-dispersion element 25, the straight polarity toner is attached to the image carrier body 11 by an electric potential formed in the collection section S3. The reverse polarity toner moves to the collection section S3 and is attached to the anti-toner-dispersion element 25 by the electric potential formed in the collection section S3.

The collection bias may be supplied by a separate power source. However, as shown in FIG. 4, the power source structure may be simplified so that the collection bias is supplied by a branch-circuit of the power source 30 for supplying the changing bias. In this case, the collection bias has the same voltage of the charging bias.

An example of the collection bias will now be described in detail.

The straight polarity toner used in developing is negatively charged. A charging bias of −1,400 V is applied to the charging unit 15 (see FIG. 2), so that the outer circumferential surface of the image carrier body 11 has an electric potential of approximately −700 V. A laser beam is irradiated onto the outer circumferential surface of the image carrier body 11 to form the image portion having a negative electric potential in the range of tens of volts. Accordingly, the electrostatic latent image is formed while the non-image portion of the image carrier body 11 maintains −700 V, and the image portion thereof maintains a negative potential in the range of tens of volts. The developing bias is applied to charge the outer circumferential surface of the developing roller 21 to approximately −400 V. The collection bias of −1,400 V (supplied by a branch-circuit of the power source 30 that supplies the charging bias to the charging unit 15) is applied to the anti-toner-dispersion element 25. As a result, the anti-toner-dispersion element 25 has a lower electric potential than the image portion and the non-image portion of the image carrier body 11. Thus, if the toner dispersed from the developing roller 21 moves to the collection section S3 between the image carrier body 11 and the anti-toner-dispersion element 25, the straight polarity toner is attached to the outer circumferential surface of the image carrier body 11 under the influence of the electrostatic force F1, and the reverse polarity toner is attached to the anti-toner-dispersion element 25 under the influence of the electrostatic force F2.

As the image carrier body 11 rotates, the straight polarity toner attached to the image carrier body 11 enters the developing section S2. The developing roller 21 has a higher electric potential than the non-image portion of the image carrier body 11, but a lower electric potential than the image portion of the image carrier body 11. Thus, in the straight polarity toner which has moved to the developing section S2, the toner attached to the non-image portion of the image carrier body 11 is collected by the electrostatic force F3 acting towards the developing roller 21, and the toner attached to the image portion remains intact. Accordingly, the anti-toner-dispersion element 25 of the present invention supports the process of electrostatic latent image forming by attaching the toner to the image portion using the dispersed toner.

Meanwhile, the reverse polarity toner attached to the anti-toner-dispersion element 25 may be separated from the anti-toner-dispersion element 25 by gravity if more than a desired amount of toner is collected or if the electric field between the image carrier body 11 and the anti-toner-dispersion element 25 disappears when the power source 30 of the image forming apparatus is turned off. Thus, the anti-toner-dispersion element 25 may be located under the image carrier body 11 or at the side of the image carrier body 11 to prevent the reverse polarity toner attached to the anti-toner-dispersion element 25 from falling onto the image carrier body 11.

Further, since the collected reverse polarity toner is attached and accumulates on the anti-toner-dispersion element 25, the accumulated reverse polarity toner may be removed, or the anti-toner-dispersion element 25 may be replaced. For example, the anti-toner-dispersion element 25 may be located in the frame 29 of the developing unit 20 on which the developing roller 21 is attached, allowing the anti-toner-dispersion element 25 to be replaced along with the developing unit 20.

In addition, the anti-toner-dispersion element 25 may be an inclined panel electrode which allows the accumulated toner to fall inside the developing unit 20, or may be an electrode having a plurality of wires or a mesh. When the inclined panel electrode is used, the accumulated reverse polarity toner slides down the panel. When wire or mesh electrodes are used, the accumulated reverse polarity toner falls through the gaps between the wires or in the mesh. The fallen toner may be collected in a toner storage 28 having the stirrer 22, for recycling. The fallen toner may move towards the stirrer 22 for recycling after being collected in the toner storage 28.

The electrophotographic image forming apparatus described above uses a non-contact developing method in which the developing roller 21 and the image carrier body 11 are separated from each other, but the present invention is not limited to this particular configuration. The anti-toner-dispersion element 25 of the present invention may be also used in a contact type developing method, since the toner may be dispersed between the exposing section S1 and the developing section S2.

Further, the electrophotographic image forming apparatus described uses a hybrid developing method, in which a two-component developing material charges the non-magnetic toner by using magnetic carriers, and the electrostatic latent image is developed by attaching only charged toner to the developing roller 21 to be moved to the image carrier body 11, but this is only an exemplary embodiment. The present invention is not limited to this developing method, and any image forming apparatus may be used provided the electrostatic latent image is formed on the image carrier body 11 using toner supplied by the developing roller 21. For example, the present invention may be also used for image forming apparatuses using a mono-component developing method, in which insulating toner or conductive toner are used without the carriers, and in a two-component developing method, in which the toner and the two-component developing material of the magnetic carriers are used and the electrostatic latent image is formed by moving only the toner onto the image carrier body 11 from the developing roller 21 on which the toner and the magnetic carrier are attached, since the toner may be dispersed between the exposing section S1 and the developing section S2 during the developing process.

Accordingly, an electrophotographic image forming apparatus and a developing method thereof of the exemplary embodiments of the present invention have the following advantages.

First, both straight polarity and reverse polarity toner dispersed in a developing process is collected to prevent image deterioration caused by contamination of an image carrier body due to dispersed toner or by contamination of an exposing window of an exposing unit.

Second, the dispersed toner may be collected for recycling. For example, the toner attached to an image portion among the straight polarity toner collected in the image carrier body in a collection section may be used to support developing of the electrostatic latent image.

Third, a power supply structure may be simplified by supplying power from a branch-circuit of a power source for supplying a charging bias, without having to use a separate power source supplying the collection bias.

While the present invention has been particularly shown and described with reference to exemplary embodiments thereof, it will be understood by those skilled in the art that various changes in form and detail may be made therein without departing from the spirit and scope of the present invention as defined by the appended claims.

What is claimed is:

1. An electrophotographic image forming apparatus comprising:

an image carrier body on which an electrostatic latent image is formed;

a developing roller which faces the image carrier body and supplies toner to the electrostatic latent image formed on the image carrier body; and an anti-toner-dispersion element which faces an outer circumferential surface of the image carrier body between an exposing section where the electrostatic latent image is formed and a developing section where the electrostatic latent image is developed by the developing roller, and wherein a collection bias is applied to the anti-toner-dispersion element to collect dispersed toner from the developing roller;

wherein the collection bias is applied such that straight polarity toner dispersed from the developing roller is collected on the image carrier body and reverse polarity toner dispersed from the developing roller is collected on the anti-toner-dispersion element.

2. The apparatus of claim 1, wherein the developing roller develops the electrostatic latent image in a non-contact manner.

3. The apparatus of claim 1, wherein the straight polarity toner is negatively charged, and the collection bias has a negative voltage less than the electric potential of a non-image portion of the image carrier body.

4. The apparatus of claim 1, wherein the reverse polarity toner collected in the anti-toner-dispersion element is collected in a toner storage that stores toner supplied to the developing roller.

5. The apparatus of claim 1, further comprising:

a charging unit which faces the image carrier body and to which a charging bias is applied to uniformly charge the outer circumferential surface of the image carrier body; and a power source for supplying the charging bias to the charging unit, wherein the collection bias is supplied by a branch-circuit of the power source.

6. The apparatus of claim 1, wherein the anti-toner-dispersion element is located under the image carrier body.

7. The apparatus of claim 1, wherein the anti-toner-dispersion element is located at a side of the image carrier body.

8. The apparatus of claim 1, wherein the anti-toner-dispersion element is separated from the image carrier body along the outer circumferential surface of the image carrier body by a uniform distance.

9. The apparatus of claim 1, wherein the anti-toner-dispersion element is a conductive electrode comprising one of a metal plate, a plurality of wires, or a mesh.

10. The apparatus of claim 1, further comprising:

a charging unit which faces the image carrier body and to which a charging bias is applied to uniformly charge the outer circumferential surface of the image carrier body; and a power source for supplying the charging bias to the charging unit, wherein the collection bias is supplied by a branch-circuit of the power source.

11. The apparatus of claim 1, wherein the anti-toner-dispersion element is located under the image carrier body.

12. The apparatus of claim 1, wherein the anti-toner-dispersion element is located at a side of the image carrier body.

13. The apparatus of claim 1, wherein the anti-toner-dispersion element is separated from the image carrier body along the outer circumferential surface of the image carrier body by a uniform distance.

14. The apparatus of claim 1, wherein the anti-toner-dispersion element is a conductive electrode comprising one of a metal plate, a plurality of wires, or a mesh.

15. A method for developing an electrostatic latent image comprising the steps of:

exposing an image carrier body in an exposing section to form an electrostatic latent image on the image carrier body; and supplying toner from a developing roller having a toner layer onto the image carrier body on which the electrostatic latent image is formed in a developing section, wherein straight polarity toner dispersed between the exposing section and the developing section is attached to the image carrier body, and reverse polarity toner dispersed to the developing roller is attached to an electrode by applying a bias to the electrode which faces the outer circumferential surface of the image carrier body between the exposing section and the developing section, and the straight polarity toner attached to a non-image portion of the image carrier body is collected onto the developing roller in a developing section using a developing bias applied to the developing roller.

16. The method of claim 15, wherein the developing roller does not contact the image carrier body.

17. The method of claim 16, wherein the reverse polarity toner attached to the electrode are collected in a toner storage that stores toner supplied to the developing roller for recycling.

18. An electrophotographic image forming apparatus comprising:

an image carrier body;

an exposing unit for irradiating light onto the image carrier body to form an electrostatic latent image on the image carrier body, the exposing unit being located in an exposing section;

a developing roller for supplying toner to the electrostatic latent image formed on the image carrier body to develop the electrostatic latent image, the developing roller being located in a developing section; and means for minimizing toner dispersion disposed between the exposing section and the developing section;

wherein a collection bias charge is applied to the means for minimizing toner dispersion so that straight polarity toner dispersed between the exposing section and the developing section is attached to the image carrier body, and reverse polarity toner dispersed to the developing roller is attached to the means for minimizing toner dispersion.

19. The apparatus according to claim 18, wherein the means for minimizing toner dispersion is spaced a substantially uniform distance away from the image carrier body.

* * * * *